United States Patent [19]

Maxwell

[11] 4,439,166

[45] Mar. 27, 1984

[54] ADJUSTABLE WATER SKI FIN AND WING

[76] Inventor: Ralph A. Maxwell, Box 245, Sweetwater, Hammonton, N.J. 08037

[21] Appl. No.: 303,883

[22] Filed: Sep. 21, 1981

[51] Int. Cl.[3] ..... A63C 15/00

[52] U.S. Cl. ..... 441/79; 114/130; 114/138; 114/141

[58] Field of Search ..... 441/68, 79; 114/130, 114/138, 141

[56] References Cited

U.S. PATENT DOCUMENTS

| | | | |
|---|---|---|---|
| 3,066,327 | 12/1962 | Durfey | 441/79 |
| 3,087,173 | 4/1963 | Meyer | 441/79 |
| 3,182,341 | 5/1965 | Rieffle | 441/79 |
| 3,201,807 | 8/1965 | Weaver | 441/79 |
| 3,516,100 | 6/1970 | Ellis | 441/79 |
| 4,320,546 | 3/1982 | Knox | 441/79 |

FOREIGN PATENT DOCUMENTS

| | | | |
|---|---|---|---|
| 2802058 | 1/1978 | Fed. Rep. of Germany | 114/130 |
| 2010189 | 6/1979 | United Kingdom | 114/130 |

OTHER PUBLICATIONS

Spray's Water Ski Magazine, 7/81, vol. 5, No. 5, pp. 37–39, "Winged Wonders . . . Foils", by Schuberth.

*Primary Examiner*—Trygve M. Blix
*Assistant Examiner*—C. T. Bartz
*Attorney, Agent, or Firm*—Duffield & Lehrer

[57] ABSTRACT

A water ski fin is carried by a housing mounted to the upper surface of the rear end of a ski with the fin extending downwardly through an elongated slot in the ski. The fin carries a transversely extending wing thereon and the combination is capable of being pivoted relative to the housing and ski to thereby change the angle of the wing. Movement is accomplished by a handle on one side of the housing which rotates a cam element which, in turn, engages an opening in the fin adjacent the top thereof. A locking device maintains the wing and fin in the desired position by preventing further movement of the cam element.

8 Claims, 5 Drawing Figures

ADJUSTABLE WATER SKI FIN AND WING

BACKGROUND OF THE INVENTION

The present invention is directed toward a water ski fin and wing and more particularly toward a fin and wing which is adjustable, thereby being capable of changing the angle of the wing.

Conventional water skis and particularly those utilized for slalom skiing include a fin or rudder on the undersurface thereof and adjacent the rear portion of the ski. These fins serve to stabilize the rear end of the ski thus making it easier for a skier to control his skis. Such skis are described, for example, in U.S. Pat. Nos. 3,066,327 and 3,087,173 which also include a means for retracting the fin. Furthermore, U.S. Pat. No. 3,201,807 illustrates an example of a pair of angularly related stabilizer fins.

More recently, it has been found that fin slippage could be reduced by providing the fins with horizontally extending wings. It has also been found that the wings could also act as brakes. These wings are normally permanently mounted on the fin at an angle slightly downwardly.

The angular position of the wings has been found to significantly affect the performance of a ski and skier. There are numerous and varying factors, however, which may determine the optimum angular position of the wings. Accordingly, adjustable wings have been proposed which allow the skier to set the angle of the wings.

Insofar as applicant is aware, the only adjustable wing presently being sold is the "Dynafoil" wing manufactured by Accusport, Inc. of Orlando, Fla. This wing is screwed to a shaft located on the fin which extends upwardly through the ski and is coupled to a knob on the upper surface of the ski. When the knob is turned, the shaft and the wing are moved. However, the screws and the portion of the wings to which the screws are applied extend beyond the smooth surface of the fin and, accordingly, create unwanted drag.

SUMMARY OF THE INVENTION

The present invention is designed to overcome the problems with the prior art described above and provides a wing for a water ski fin which is not only easily adjustable but which does not add any unwanted or additional drag. In accordance with the invention, a water ski fin is carried by a housing mounted to the upper surface of the rear end of a ski with the fin extending downwardly through an elongated slot in the ski. The fin carries a transversely extending wing thereon and the combination is capable of being pivoted relative to the housing and ski to thereby change the angle of the wing. Movement is accomplished by a handle on one side of the housing which rotates a cam element which, in turn, engages an opening in the fin adjacent the top thereof. A locking device maintains the wing and fin in the desired position by preventing further movement of the cam element.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
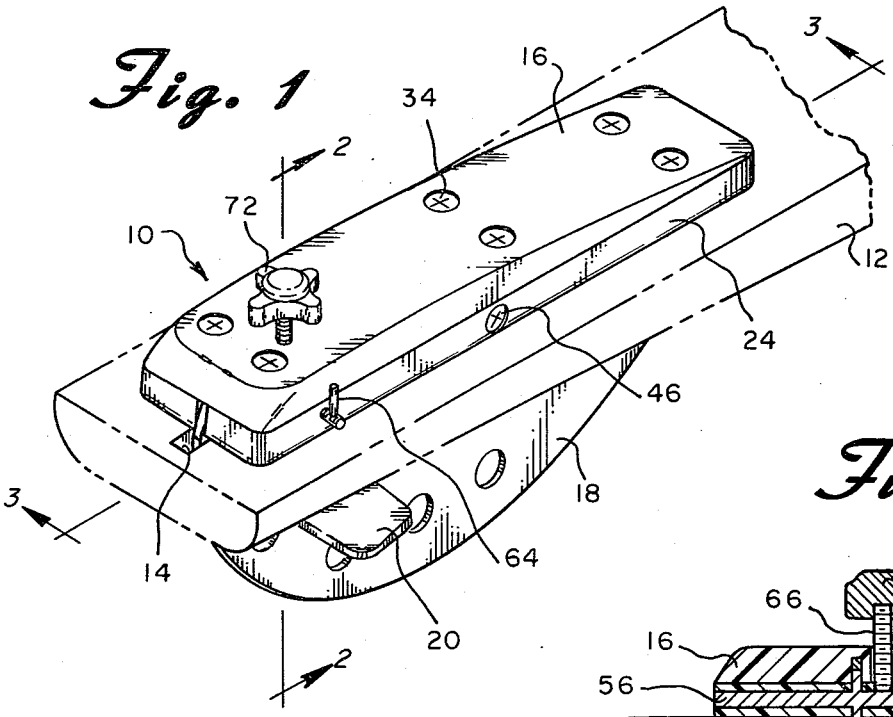
FIG. 1 is a perspective view of an adjustable water ski fin and wing constructed in accordance with the principles of the present invention and being shown mounted on a ski.

Referring now to the drawings in detail wherein like reference numerals have been used throughout the various figures to designate like elements, there is shown in FIG. 1 an adjustable water ski fin and wing constructed in accordance with the principles of the present invention and designated generally as 10. The device 10 is shown mounted on the rear end of a ski 12. The ski includes an elongated slot 14 therein which passes entirely through the ski adjacent the centerline thereof. The ski 12 is, per se, conventional. Accordingly, only a portion thereof has been shown in the drawings.

Figure 2:
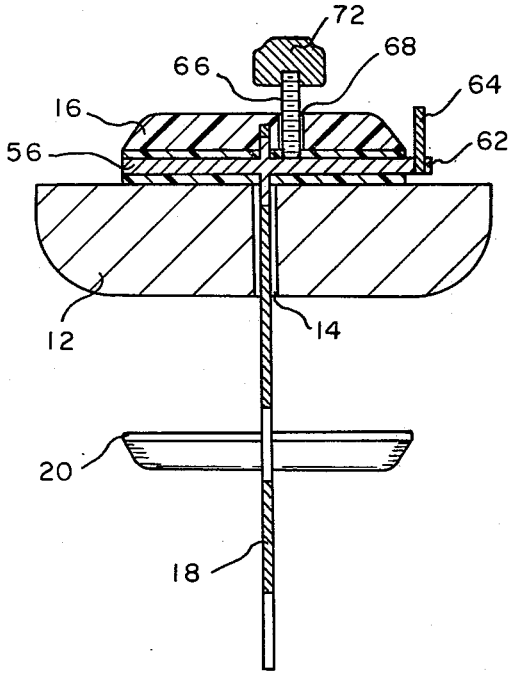
FIG. 2 is a cross-sectional view taken through the line 2—2 of FIG. 1.

The device 10 is comprised essentially of three principal parts: a housing or mounting means 16, a fin 18 and a wing 20. As shown most clearly in FIG. 2, the entire housing or mounting means 16 is located on the upper surface of the ski 12. The fin 18 extends downwardly through the slot 14 perpendicular to the housing 16 and ski 12. Wing 20 is perpendicular to the surface of the fin 18 and extends on either side thereof.

Figure 4:
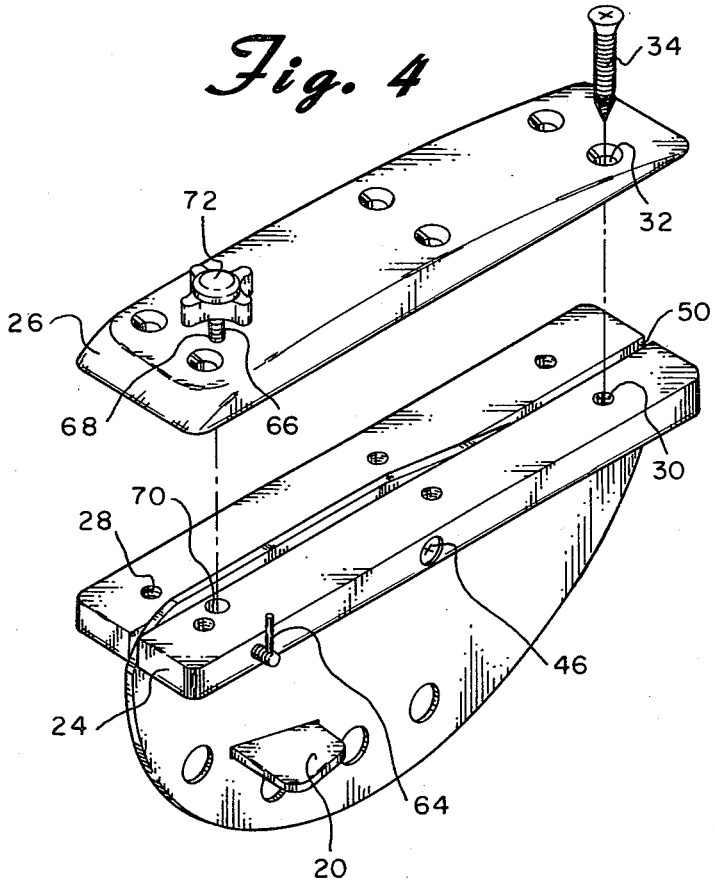
FIG. 4 is a perspective view partially exploded.

The mounting means 16 is relatively shallow and is substantially rectangularly shaped. As shown most clearly in FIGS. 4 and 5, the mounting means 16 includes two substantially identical lower sections 22 and 24 and a cover member 26. Each of the lower sections 22 and 24 and the cover member 26 includes a plurality of holes therein such as shown at 28, 30 and 32, respectively, through which may pass screws 34. Screws 34 pass directly into the ski 12 for maintaining the mounting means 16 and thus the entire assembly 10 in place.

Figure 3:
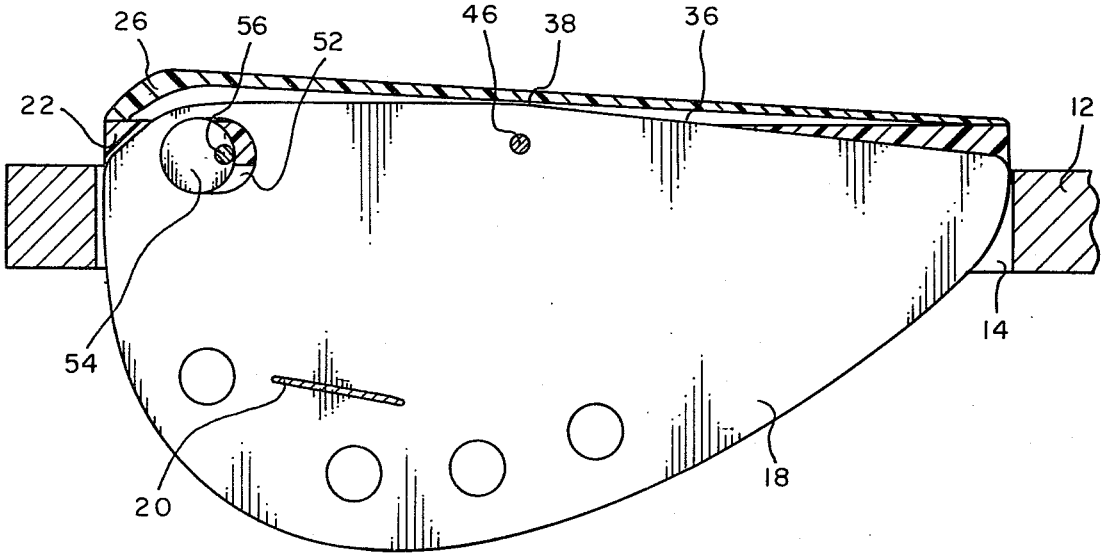
FIG. 3 is a cross-sectional view taken through the line 3—3 of FIG. 1.
Figure 5:
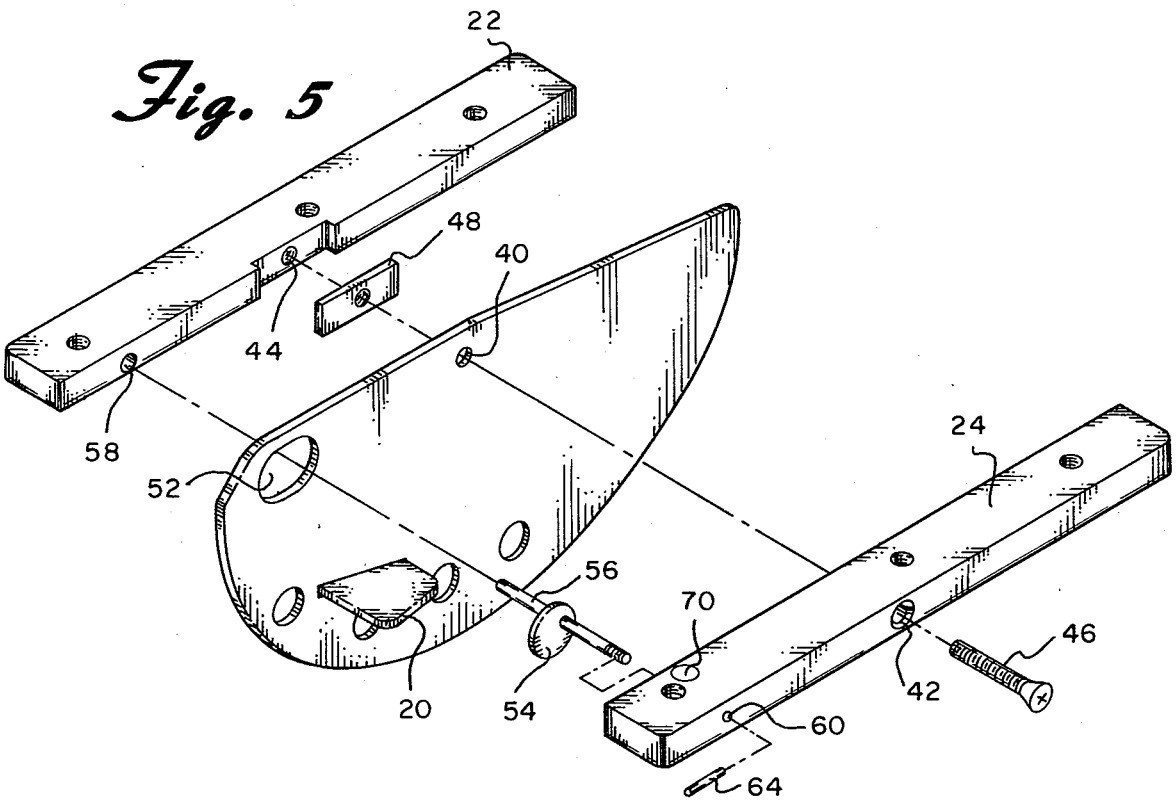
FIG. 5 is an exploded view of the lower portion of FIG. 4.

Referring to FIGS. 3 and 5, it can be seen that the upper edge 36 of the fin 18 tapers slightly downwardly from either side of a high point 38 which is located at the substantial middle of the fin. Located just below the point 38 is an aperture 40. Similar apertures 42 and 44 are formed in the lower sections 22 and 24 of the mounting means 16. An elongated screw 46 extends through the apertures 42, 40 and 44 and is maintained in place by a nut 48. The lower sections 22 and 24 of the mounting means 16 are not pulled tightly toward each other. Rather, there is a space 50 left therebetween which is sufficient to allow the fin 18 to freely pivot about the screw 46 which functions as a pivot pin.

A second and larger aperture or opening 52 is formed in the fin 18 rearward of the opening 40 and also adjacent the upper edge 36. Preferably this opening 52 is oblong as shown. Loosely fitted within the opening 52 is a circular or round disc member 54 which is rigidly secured to an axle 56. Axle 56, in turn, is supported in aperture 58 of the lower mounting member 22 and a similar aperture 60 in the lower half 24.

Preferably, axle 56 is parallel to the axis of the screw 46. As shown most clearly in FIG. 3, however, disc member 54 is not coaxially mounted on axle 56, that is, it is obliquely mounted thereon. It should, therefore, be readily apparent that as axle 56 is rotated, disc 54 will move up or down and will function as a cam element against the inner surface of the opening 52 to move the rear end of the fin 18 up or down about the pivot pin 46.

In order to allow axle 56 and therefore disc 54 to rotate, the axle extends all the way through the aperture 60 as shown at 62. A small lever or handle 64 is fitted into the end portion 62 to provide leverage means for rotating the axle 56. When the disc 54 has been rotated into its desired position, it is desired to lock the same therein and for this purpose, a screw 66 is threaded into opening 68 in the cover member 26. As shown most clearly in FIG. 4, this opening 68 overlies an aperture 70 in the lower portion 24 which also overlies the axle 56 (see FIG. 2). A handle 72 is fitted onto the top of the screw 66. Thus, when handle 72 is turned and screw 66 moves downwardly, the lower end of the screw is forced against the axle 56 preventing the same from turning and thereby locking the axle 56, the disc 54 and the fin 18 in the desired position.

Wing 20 is preassembled onto the fin 18 and the entire assembly 10 can be mounted on a water ski by disassembling the fin 18 from the mounting means 16 including lower sections 22 and 24 and by inserting the fin upward through the slot 14 from the bottom of the ski 12. Alternatively, with an open end slotted ski, fin 18 can be inserted into the rear of the slot. Utilizing screws 34 passing through the plurality of holes such as 28, 30 and 32, the assembly 10 is secured to the upper surface of ski 12. In either case, and as can clearly be seen from FIG. 2, the sides of fin 18 are very smooth. There are no projections which would cause unwanted drag.

As can be seen from FIG. 3, the wing 20 is preferably arranged to be at a slight angle downwardly when the fin is in its median position. When axle 56 is rotated clockwise as viewed in FIG. 3, disc 54 will move upwardly causing the rear end of fin 18 to move upwardly and increasing the angle of wing 20. If axle 56 is rotated counterclockwise, however, the rear end of fin 18 will move downwardly decreasing the angle of wing 20. When the wing is in its desired angular position, it is locked therein by turning knob 72.

The present invention may be embodied in other specific forms without departing from the spirit or essential attributes thereof and accordingly, reference should be made to the appended claims rather than to the foregoing specification as indicating the scope of the invention.

I claim:

1. An adjustable water ski fin and wing assembly comprising:

a shallow substantially rectangularly shaped mounting means, said mounting means being adapted to overlie an elongated longitudinally extending slot in the rear end of a water ski;

means for securing said mounting means to the upper surface of said ski;

a fin including a top edge lying substantially totally within said mounting means and extending downwardly therefrom through said slot;

a pivot pin located adjacent said top edge of said fin for pivotally fastening said fin to said mounting means, said pin extending transversely of said mounting means;

a wing extending outwardly from either side of said fin and substantially perpendicular thereto;

means for manually pivoting said fin including a first cam element located within said mounting means and including a handle portion extending to the exterior of said mounting means and a second cam element carried by said fin adjacent one end of said top edge in cooperative relationship with said first cam element, and means for locking said fin to prevent pivotal movement thereof.

2. The invention as claimed in claim 1 wherein said locking means includes means for preventing movement of said handle.

3. The invention as claimed in claim 1 wherein said pivot pin is located adjacent the mid portion of said fin.

4. The invention as claimed in claim 1 wherein said first cam element is a substantially round member obliquely mounted on an axle, said axle extending to the exterior of said mounting means.

5. The invention as claimed in claim 4 wherein said means for locking includes means for preventing movement of said axle.

6. The invention as claimed in claim 4 wherein said second cam element is comprised of an opening within said fin, said round member of said first cam element being located within said opening.

7. The invention as claimed in claim 6 wherein the axes of said pivot and said axle are substantially parallel.

8. The invention as claimed in claim 1 wherein said fin is pivotally fastened by way of a fixed pivot pin which substantially prevents linear movement of said fin.

* * * * *